US005098003A

United States Patent [19]

Young et al.

[11] Patent Number: 5,098,003

[45] Date of Patent: Mar. 24, 1992

[54] FASTENER DRIVING APPARATUS AND METHOD

[75] Inventors: Alfred Young; Fred E. Church, both of Hickory, N.C.

[73] Assignee: Design Tool, Inc., Hickory, N.C.

[21] Appl. No.: 749,473

[22] Filed: Aug. 15, 1991

Related U.S. Application Data

[63] Continuation of Ser. No. 546,047, Jun. 28, 1990, abandoned.

[51] Int. Cl.[5] ..... B25C 1/04

[52] U.S. Cl. ..... 227/114; 227/117; 227/149

[58] Field of Search ..... 227/149, 147, 112, 114, 227/117

[56] References Cited

U.S. PATENT DOCUMENTS

| | | | |
|---|---|---|---|
| 1,488,161 | 3/1924 | McCormick | 227/114 |
| 1,703,458 | 2/1929 | Ruff . | |
| 1,726,012 | 8/1929 | Bilz | 227/149 |
| 1,980,967 | 11/1934 | De Mooy . | |
| 2,534,140 | 12/1950 | Moore . | |
| 2,951,516 | 9/1960 | Chilton . | |
| 2,973,021 | 2/1961 | Crossen . | |
| 2,994,880 | 8/1961 | Willis . | |
| 3,049,713 | 8/1962 | Dupuy et al. | 227/112 |
| 3,247,874 | 4/1966 | MacDonald . | |
| 3,283,985 | 11/1966 | Willis . | |
| 3,305,155 | 2/1967 | Willis . | |
| 3,587,683 | 6/1971 | Bangerter | 144/32 |
| 3,875,982 | 4/1975 | Mizu et al. | 144/32 |
| 3,900,131 | 8/1975 | Ehrlich | 221/169 |
| 3,930,808 | 1/1976 | Miller et al. | 29/200 P |
| 3,946,926 | 3/1976 | Willis | 227/112 |
| 3,958,614 | 5/1976 | Bandera | 144/32 R |
| 4,114,663 | 9/1978 | Viner | 144/32 R |
| 4,194,665 | 3/1980 | Maestri | 227/112 |
| 4,333,367 | 6/1982 | Taffer | 81/430 |

*Primary Examiner*—Frank T. Yost
*Assistant Examiner*—John M. Husar
*Attorney, Agent, or Firm*—Bell, Seltzer, Park & Gibson

[57] ABSTRACT

A fastener introduced into the barrel of the apparatus is received by a movable fastener retainer. The fastener is moved by a fastener positioning member to a ready to drive position prior to being driven from the outlet of the apparatus by a driver member. The shank of fastener in its ready to drive position extends generally parallel to the central axis of the barrel and its pointed free end preferably is adjacent the barrel outlet. A complete cycle of operation of the apparatus ensues in response to operator movement of a trigger of the apparatus.

12 Claims, 3 Drawing Sheets

FASTENER DRIVING APPARATUS AND METHOD

This application is a continuation of application Ser. No. 07/546,047, filed June 28, 1990, now abandoned.

FIELD OF THE INVENTION

This invention relates to apparatuses for driving headed fasteners, such as nails and tacks, sequentially delivered thereto from a suitable source. The invention also relates to methods of operating such apparatuses.

BACKGROUND OF THE INVENTION

Known fastener driving apparatuses, such as that disclosed in Willis U.S. Pat. No. 2,994,880, include a barrel having fastener inlet and outlet openings, a retainer mechanism for preventing premature passage of a fastener through the barrel outlet, and a reciprocatorily movable fastener driver that at desired times drives a fastener within the barrel to and from the fastener outlet and into an adjacent workpiece. If the shank of a fastener does not extend substantially parallel to the axis of the barrel as it is driven through and from the barrel, jamming of the apparatus and/or driving of the fastener into the workpiece at an undesirable angle may occur.

SUMMARY OF THE INVENTION

The present invention provides an improved fastener driving apparatus and related method for insuring that the shank portion of each fastener driven through and from the apparatus extends substantially parallel to its barrel. In a preferred embodiment thereof, the apparatus includes fastener retainer, driver and positioning members that are reciprocatorily movable longitudinally of the barrel relative to each other. At the outset of a fastener-driving operation, forward movement of the positioning member moves a fastener retained by the fastener retainer to a ready-to-drive position wherein the shank portion of the fastener extends substantially parallel to the longitudinal axis of the barrel. The positioning member maintains the fastener in the foregoing ready-to-drive position as the fastener driver of the apparatus moves forwardly relative to the positioning and retainer members into driving engagement with the fastener. In a preferred embodiment of the invention, the desired sequence of movements of the positioning and driver members, and the introduction of fasteners into the apparatus, are conveniently realized by movement of a trigger-like actuating element of the apparatus.

DESCRIPTION OF THE DRAWINGS

Other features of the invention will be apparent from the following description of an illustrative embodiment thereof, which should be read in conjunction with the accompanying drawings in which.

DESCRIPTION OF THE ILLUSTRATED EMBODIMENT

Figure 1:
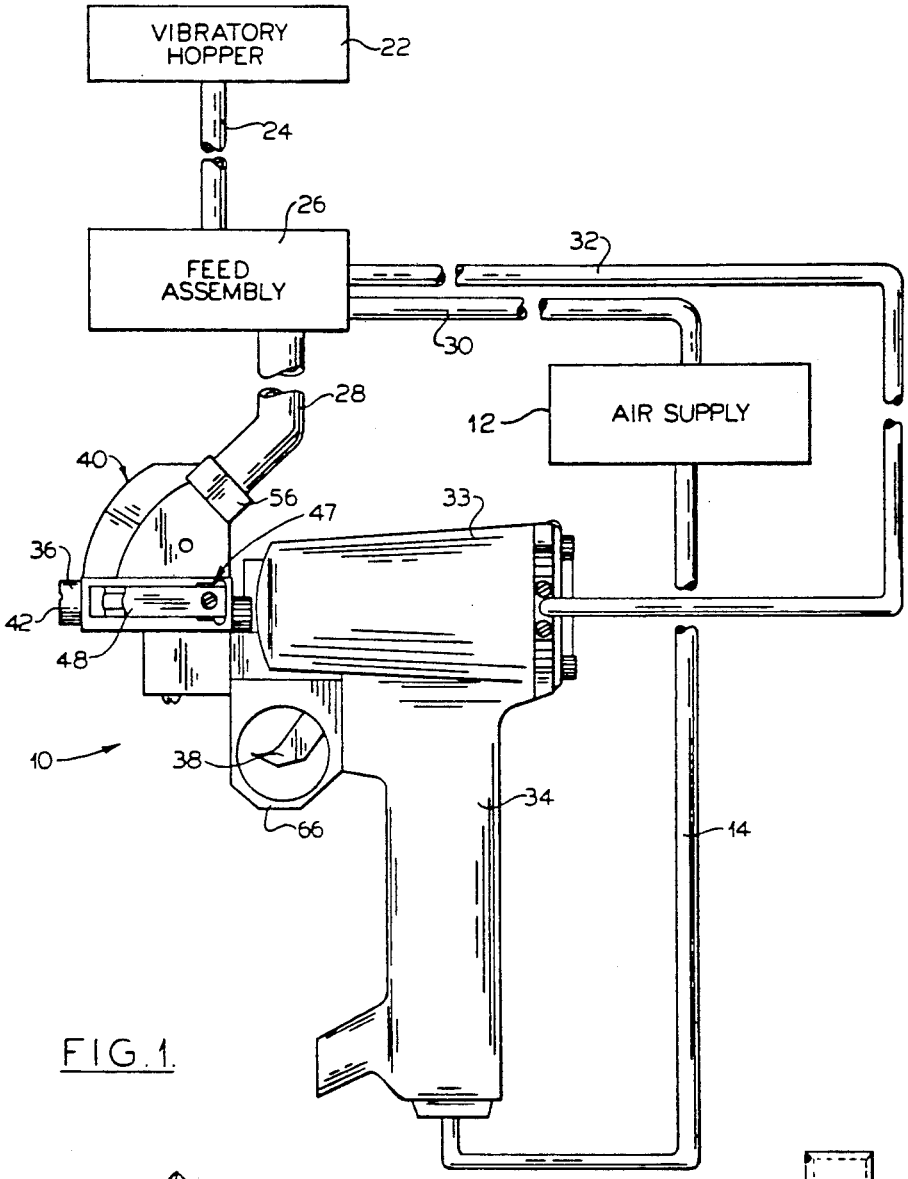
FIG. 1 is a side elevational view of a fastener driving apparatus in accordance with the invention, some fastener supply and pneumatic circuit components associated therewith also being diagrammatically and/or schematically shown.
Figure 2:
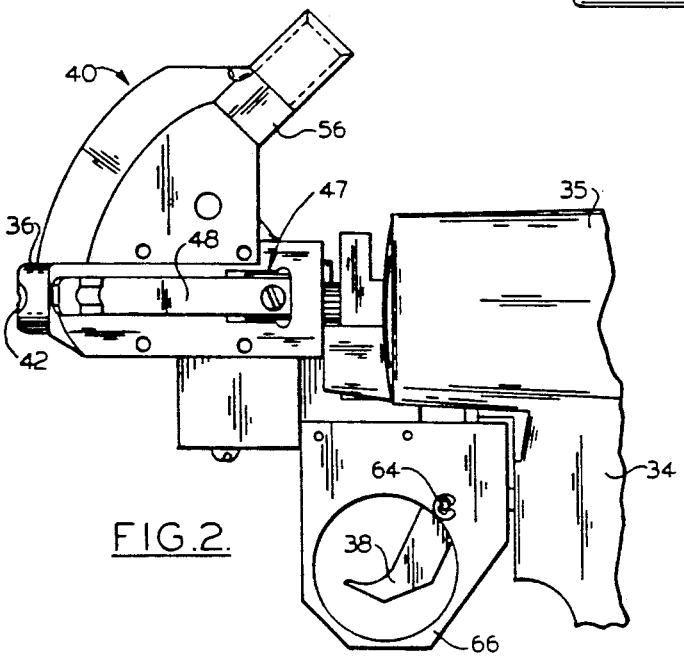
FIG. 2 is an enlarged fragmentary side elevational view of the forward part of the fastener driving apparatus.
Figure 3:
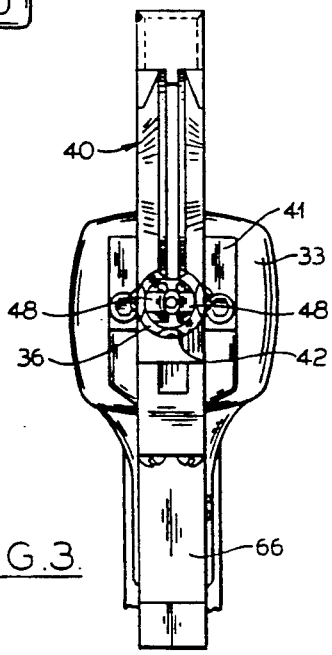
FIG. 3 is a fragmentary front elevational view of the apparatus.
Figure 4:
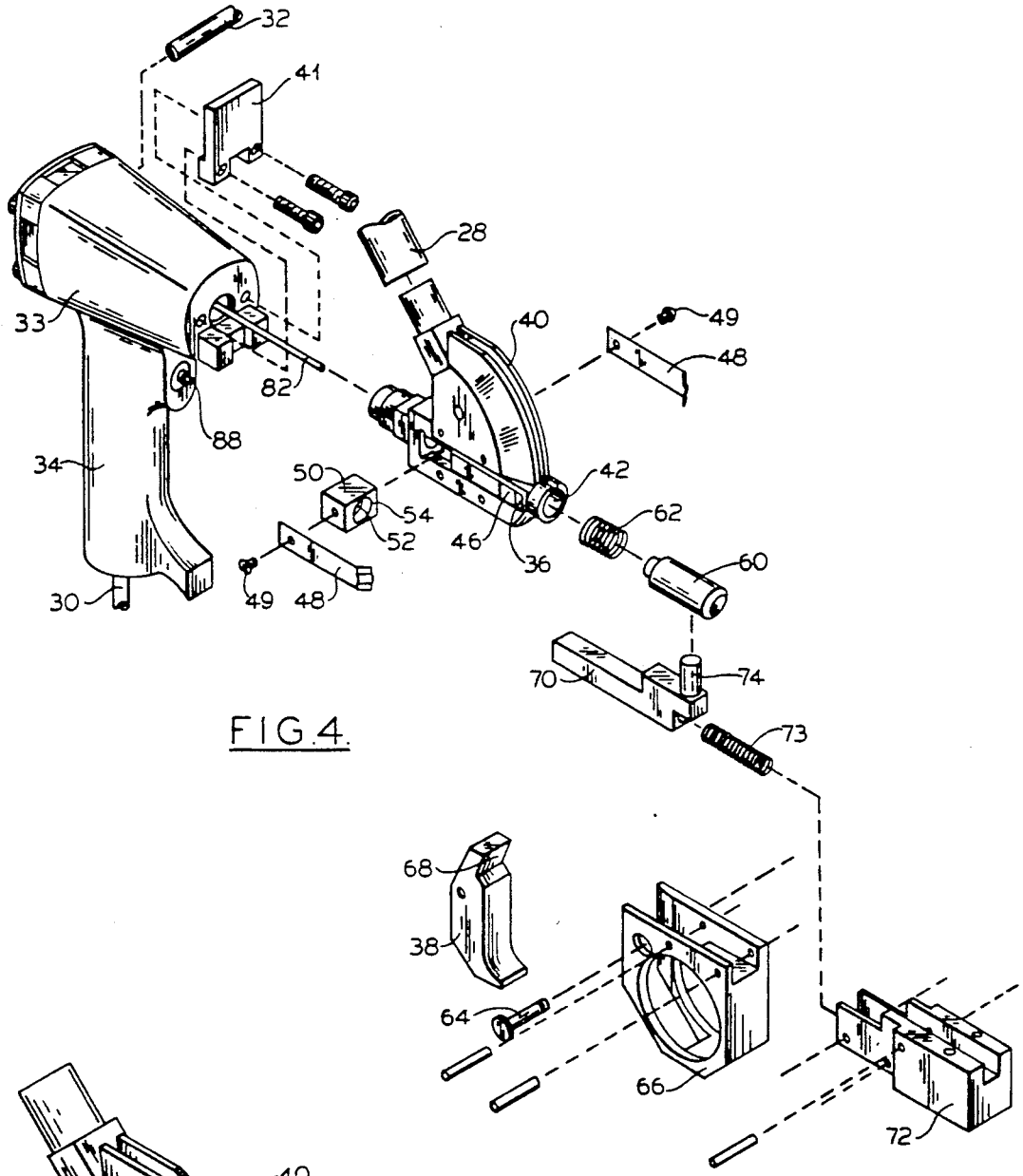
FIG. 4 is a partially exploded perspective view of the apparatus.

The fastener driving apparatus 10 shown in FIG. 1 is illustratively of a pneumatically powered type. Compressed air is conducted to it by a flexible conduit 14 from a suitable air supply source 12. The fasteners 16 (FIGS. 5-8) driven by apparatus 10 illustratively are decorative nails having a rounded head portion 18 and a pointed shank portion 20. Fasteners 16 are delivered to apparatus 10 at desired times from a suitable supply source, such as a vibratory hopper 22, via a conduit 24, fastener feed assembly 26, and a flexible fastener supply conduit 28. During operation of apparatus 10, a conduit 30 conducts compressed air from supply source 12 into the inlet of fastener supply conduit 28, preferably on a continuous basis. Another flexible conduit 32 interconnects apparatus 10 and fastener feed assembly 26. Air conducted at desired times through conduit 32 controls the operation of a fastener transport mechanism (not shown) of assembly 26. When compressed air passes through conduit 32 from apparatus 10 to assembly 26, no fasteners are discharged from the assembly. Upon each cessation of the flow of compressed air through conduit 32, assembly 26 discharges a fastener 16 into conduit 28. Mechanisms for supplying fasteners and compressed air to fastener driving apparatuses are well known to those skilled in the art, and those associated with apparatus 10 may be of any suitable type.

Referring now also to other figures of the drawings, apparatus 10 illustratively and preferably has a pistol-like shape. It includes a main body portion 33, a downwardly extending handle member 34, a forwardly extending cylindrical barrel 36, a trigger member 38, and a fastener orienting member 40.

Barrel 36 is releasably connected to main body portion 33 of apparatus 10 by a plate 41 and suitable screw-type fasteners. The barrel has a fastener outlet 42 at its forward end, and a generally T-shaped fastener inlet 44 (best shown in FIG. 9) in its upper portion. A pair of elongate resilient spring elements 48 overlie opposite sides of barrel 36, and constitute part of a retainer assembly 47 for preventing premature passage of fasteners 16 from outlet 42. The forward end portions of springs 48 project into barrel 36, at angles of approximately 45°, through openings 46 upon opposite sides of the barrel. The rear end portions of springs 48 are secured by screws 49 to a spring support member 50 of the retainer assembly. Member 50 is mounted within a rearward portion of barrel 36 for limited reciprocatory movement axially of the barrel. Member 50 has a countersunk portion 52 adjacent its forward end, and a central bore 54.

Figure 9:
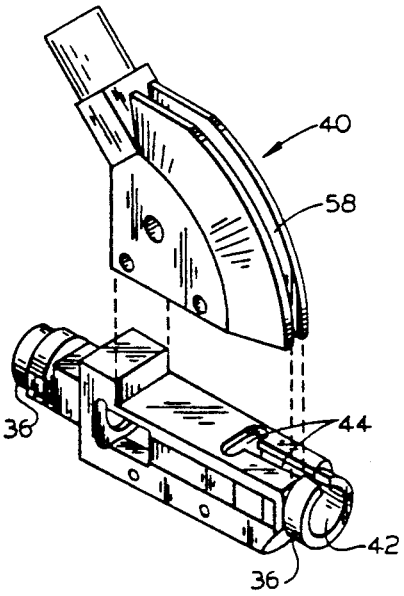
FIG. 9 is an enlarged, exploded perspective view of fastener orienting and barrel components of the apparatus.
Figure 5:
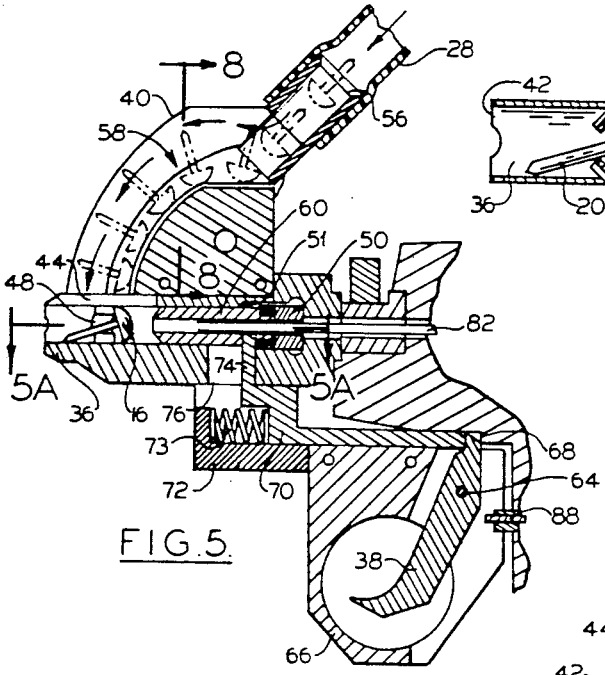
FIG. 5 is a vertical sectional view through the forward part of the apparatus.
Figure 5A:
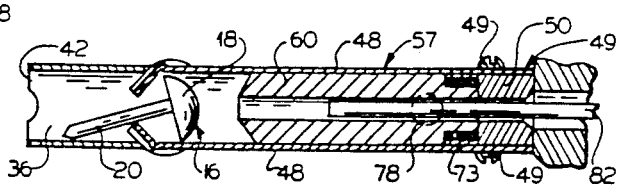
FIG. 5A is an enlarged sectional view, taken substantially along the line 5A—5A of FIG. 5, through the barrel and adjacent components of the apparatus.

Referring now particularly to FIG. 5, fastener orienting member 40 extends upwardly from barrel 36. At its upper end member 40 has a inclined fastener inlet opening 56 that communicates with the tubular conduit 28 leading to fastener feed assembly 26 (FIG. 1). A fastener 16 discharged from assembly 26 passes head first through conduit 28 and inlet 56 of member 40. The fastener then engages and moves along a guide track 58 having an initial straight section followed by an arcuate section that communicates at its lower end with fastener inlet 44 (FIG. 9) of barrel 36. Passage of each fastener 16 along track 58 causes it to assume an orientation wherein its pointed shank 20 extends generally forwardly as the fastener enters barrel 36 through inlet opening 44 (FIG. 9). The angularly extending forward end portions of spring elements 48 project forwardly of the head 18 of each fastener 16 entering barrel 36 through inlet 44 and, in their undeflected positions of FIGS. 5 and 5A, are so close to each other as to prevent premature passage of the fastener through outlet 42 of the barrel. Premature passage of the fastener from the barrel might otherwise occur due to gravity and/or the flow of compressed air through the forward end portion of barrel 36.

Although extending in a generally forwardly direction, the shank 20 of many of the fasteners 16 retained by retainer springs 48 will be canted, as shown in FIGS. 5 and 5A, instead of extending generally parallel to the central axis of barrel 36. If driven when in a canted orientation to and from outlet 42 of barrel 36, and into a workpiece (not shown) adjacent the forward end of the barrel, at least some of the fasteners 16 would also be canted relative to the workpiece. To prevent this undesirable result, apparatus 10 includes positioning means for moving each fastener 16 retained by retainer springs 48 to a ready-to-drive position wherein head 18 of the fastener is seated against the angularly extending free end portions of springs 48, the fastener shank 20 extends substantially parallel to the central axis of barrel 36, and the pointed free end of the shank is closely adjacent barrel outlet 42 and thus a workpiece (not shown) abutting the forward end of barrel 36. The aforesaid positioning means includes a tubular cylindrical member 60 mounted within the rearward portion of barrel 36 for reciprocatory movement axially thereof between a retracted position, shown in FIGS. 5 and 5A, and extended positions such as those shown in FIGS. 6 and 6A. In its retracted position of FIGS. 5 and 5A the rearward end of member 60 abuts the forward end of spring support member 50, and compresses a coil spring 62 disposed between such members.

Figure 6:
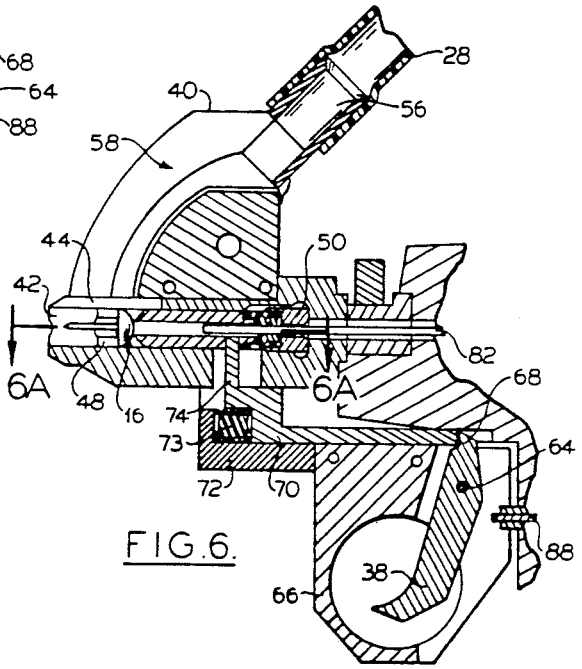
FIG. 6 is a sectional view similar to FIG. 5 showing apparatus components in the positions occupied by them at a subsequent stage of a fastener driving operation.
Figure 6A:
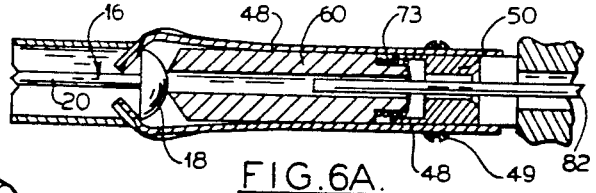
FIG. 6A is an enlarged sectional view taken substantially along the line 6A—6A of FIG. 6 but showing apparatus components in positions occupied at a later stage of the fastener driving operation.
Figure 8:
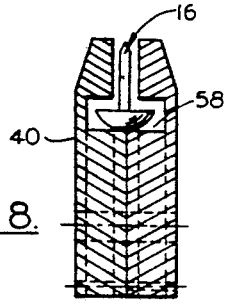
FIG. 8 is an enlarged sectional view taken substantially along the line 8—8 of FIG. 5.

Initial forward movement of member 60 from its FIG. 5 retracted position causes its forward end to engage head 18 of a fastener 16 retained by springs 48. Continued forward movement of member 60 moves fastener head 18 into seated engagement with the forward end portions of springs 48, which in turn causes the fastener's shank 20 to extend axially of barrel 36, as shown in FIG. 6. As shown in FIG. 6A, further forward movement of member 60 and fastener 16 cams the forward ends of springs 48 slightly outwardly, away from each other, and also moves the springs and their support member 50 forwardly until such movement is halted by abutment of the forward end of member 50 with a stop surface 51 (FIG. 5) within the rear portion of barrel 36. The magnitude of the aforesaid forward movement of springs 48 and fastener preferably and illustratively is such that the pointed forward end of shank 20 of the fastener 16 is disposed, in the fastener's ready-to-drive position shown in FIGS. 6A, closely adjacent outlet 42 of barrel 36, and thus closely adjacent a workpiece surface (not shown) adjacent the forward end of the barrel.

Figure 10:
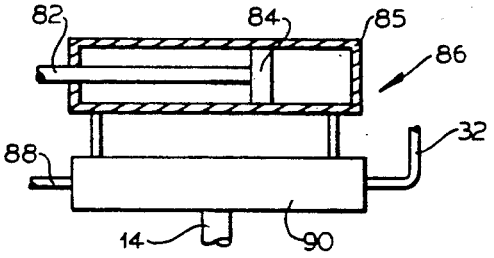
FIG. 10 is a schematic representation of pneumatic value and power components of the apparatus.

Positioning member 60 maintains fastener 16 in its aforesaid ready-to-drive position as the fastener is driven rapidly forwardly from retainer spring elements 48 and into a workpiece (not shown) abutting the forward end of barrel 36. Driving of the fastener is accomplished by an extendible and retractable fastener driver member 82, illustratively of rod-like cylindrical shape, which extends axially of barrel 36, positioning member 60, and spring support member 50. As is schematically indicated in FIG. 10 of the drawings, the rear end of driver member 82 is connected to the piston 84 of a double-acting piston-and-cylinder assembly 86 located, along with an air control valve 90, within the rear portion of housing 33 of apparatus 10. Driver 82 is driven to and maintained in its rearward position when compressed air is introduced into the forward (leftmost, as viewed in FIG. 10) end of cylinder 85 of assembly 86. The driver is moved to and maintained in a forwardmost position, such as that shown in FIG. 7, when air is introduced into the rearward (rightmost, as viewed in FIG. 10) end of cylinder 85. Air is introduced at desired times into the appropriate end of cylinder 85 by valve 90, which also at desired times directs compressed air from apparatus 10 to fastener feed assembly 26 (FIG. 1) via conduit 32. Valve 90 receives compressed air directly or indirectly from the conduit 14 communicating with air supply source 12 (FIG. 1). Passage of air from valve 90 is controlled by the position of a forwardly biased actuating element 88 slidably connected thereto and projecting therefrom through aligned openings in the rear wall of trigger guard 66 and the front wall of handle 34 of apparatus 10. Trigger 38 is mounted within trigger guard 66 by a pivot pin 64 for pivotal movement of its lower position in forward-rearward directions. During the first stages of the rearward pivotal movement of trigger 38, it engages and rearwardly (rightwardly as viewed in FIGS. 1, 2 and 6–7) moves the forwardly biased valve actuating element 88. In response to such movement valve 90 (FIG. 10) first shifts the compressed air supplied to assembly 86 from the front to the rear end of cylinder 85, and then interrupts the flow of air through conduit 32 to fastener feed assembly 26. Return forward (leftward, as viewed in FIGS. 1, 2 and 5–7) of trigger 38 and actuating element 88 sequentially causes valve 90 to again direct compressed air to fastener feed assembly 26 and to the forward end of cylinder 85.

Figure 7:
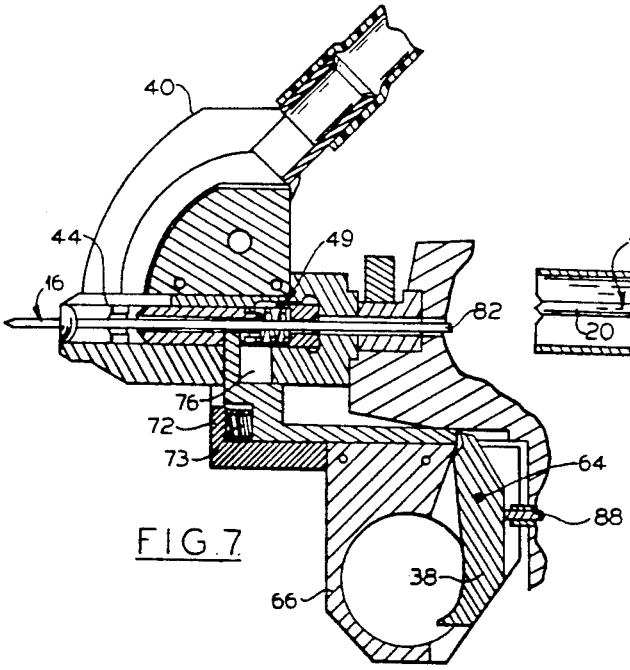
FIG. 7 is a view similar to FIG. 6 showing components of the apparatus at a still later stage of the fastener driving operation.

In addition to effecting movement at desired times of fastener driver member 82, coordinated movements of fastener positioning member 60 and retainer assembly 47 also occur in response to movement of trigger 38. A shoulder 68 upon the upper end of trigger 38 abuts the rear end of an elongated rigid link 70. Link 70 is mounted for longitudinal sliding movement, parallel to the axis of barrel 36, by a guide track 72 secured to the upper portion of trigger guard 66. A coil spring 73 disposed between confronting forwardly disposed end surfaces of link 70 and guide track 72 biases link 70 to its rearmost position shown in FIG. 5 and, by reason of the abutting engagement between the rear end of the link and shoulder 68 of trigger 38, biases the lower portion of the trigger to its FIG. 5 forwardmost position. A cylindrical stud 74 upon the forward end portion of link 70 projects through a slot-like opening 76 of barrel 36 and into a complementary blind bore 78, shown by broken lines in FIG. 5A, within the bottom of fastener positioning member 60. By reason of the aforesaid interconnection between them, longitudinal forward-rearward movement of link member 70 causes corresponding movement of positioning member 60 between its rearmost position (FIGS. 5 and 5A) and its forward positions (FIGS. 6A and 7). Movement of the aforesaid members beyond their forwardmost and rearmost positions is prevented by abutment of stud 74 with opposite end surfaces of barrel slot 76.

Prior to the commencement of a fastener driving operation, the components of apparatus 10 occupy their positions illustrated in FIGS. 5 and 5A. The fastener retainer assembly 47, positioning member 60 and driver member 82 are rearwardly retracted, and the lower portion of trigger 38 is in its forwardmost pivotal position. A fastener 16 previously introduced into apparatus 10 has its head portion 16 disposed to the rear of the inwardly inclined forward portions of springs 48. The fastener shank 20 projects angularly downwardly and forwardly from head 18, between the forward ends of springs 48. A complete cycle of operation of apparatus 10 ensues when a user of apparatus 10 pivots the lower portion of trigger 38 rearwardly to the maximum possible extent and then allows it to return to its forward position. The initial stage of the trigger's rearward movement, from its position of FIG. 5 to its position of FIG. 6, moves positioning member 60 forwardly to its position of FIG. 6. Such movement causes member 60 to firmly set head 18 to fastener 16 against the inwardly extending forward end portions of springs 48. This in turn causes the fastener shank 20 to extend generally parallel to the central axis of barrel 36. Further rearward pivotal movement of trigger 38 advances member 60 to its forwardmost position of FIG. 6A. The force exerted by member 60 upon the forward ends of springs 48 of retainer assembly 47, during the forward movement of member 60 and via the fastener 16, biases the springs slightly outwardly away from each other and moves them and their support member 50 forwardly until member 50 engages stop surface 51 (FIG. 5). The pointed end of the fastener shank is then disposed closely adjacent outlet opening 42 of the barrel, and thus closely adjacent a workpiece (not shown) engaged by the forward end of the barrel. Continued rearward pivotal movement of trigger 38, from its position of FIG. 6 to its position of FIG. 7, causes it to engage and rearwardly displace forwardly-biased actuating element 88 of the pneumatic control valve 90 within handle 34 of apparatus 10. In response to rearward movement of actuating element 88, valve 90 introduces compressed air into the rear portion of piston-and-cylinder assembly 85. This causes rapid axial movement of fastener driver member 82 from its rearward retracted position to its forward extended position shown in FIG. 7. During the course of such movement, driver member 82 engages head 18 of fastener 16 and drives the fastener forwardly from spring elements 48 and through barrel outlet 42. As the fastener moves from retainer assembly 47 the forward end portions of springs 48 are cammed outwardly to permit passage of fastener head 18. The strain imposed upon the forward end portions of springs 48 by such outward movement is lessened by their having been previously displaced slightly outwardly by forward movement of positioning member 60. At the same time as valve 90 directs pressurized air into the rear portion of cylinder 85 of assembly 86, the valve directs compressed air through control line 32 to feed assembly 26 (FIG. 1). This causes the fastener transport mechanism (not shown) of assembly 26 to move to a position wherein it receives a fastener 16. Upon release of trigger 38 by the user of apparatus 10, the coil spring 73 engaging link 70 returns the link to its rearmost position shown in FIG. 5. This in turn simultaneously returns trigger 38 and fastener positioning member 60 to their rearmost positions shown in FIG. 5. As trigger 38 moves away from the forwardly biased actuator element 88 of air control valve 90 (FIG. 10), such valve again directs compressed air into the forward end of cylinder 85. This affects axial movement of fastener driver member 82 to its retracted position of FIG. 5. At the same time, valve 90 interrupts the passage of air through control air line 32 to feed assembly 26, which causes assembly 26 to discharge another fastener 16 into conduit 28. Such fastener passes through the conduit and through orienting member 40 into barrel 36. Apparatus 10 is then again in its FIG. 5 condition of readiness for another cycle of operation.

While an illustrative embodiment of the invention has been shown and described, this was for purposes of illustration only, the scope of the invention being in accordance with the following claims.

That which is claimed is:

1. An apparatus for driving fasteners serially delivered thereto, with the fasteners each having a head portion and a pointed shank portion extending from said head portion, and comprising a tubular barrel having an internal bore which defines a forward outlet end, and a fastener inlet opening located rearwardly from said outlet end, means for serially delivering the fasteners through said fastener inlet opening and into said bore of said tubular barrel with the shank portion positioned forwardly of said head portion, a fastener retainer assembly mounted to said barrel with said fastener retainer assembly including a forward end portion which extends laterally into said bore between said fastener inlet opening and said outlet end of said barrel so as to prevent the premature passage of a fastener which has entered through said fastener inlet opening, and with said forward end portion being resiliently biased such that the same may be laterally moved outwardly against a biasing force to open said bore and permit the passage of a fastener therethrough, a tubular fastener positioning member slidably mounted in said bore of said barrel rearwardly of said fastener inlet opening, a fastener driver mounted in said bore to slidably extend coaxially through said tubular fastener, and trigger means for, upon manual actuation, (a) moving the positioning member axially forwardly to cause the head portion of a fastener in said bore to engage said forward end portion of said fastener retainer assembly and thereby coaxially align the fastener in said bore, and then (b) rapidly axially advancing said fastener driver so as to engage the head portion of the aligned fastener and drive the fastener forwardly, and thereby cause the forward end portion of said fastener retainer assembly to be laterally moved against said biasing force to permit the passage of the fastener forwardly through said outlet end of said bore.

2. The apparatus as defined in claim 1 wherein said trigger means further comprises means for, upon manual release thereof, returning the positioning member axially rearwardly and returning said fastener driver axially rearwardly.

3. The apparatus as defined in claim 2 wherein said fastener retainer assembly comprises a pair of axially extending leaf springs, with the forward end of each leaf spring extending into said bore from opposite sides thereof and forming said forward end portion.

4. The apparatus as defined in claim 3 wherein said fastener retainer assembly further comprises a support member fixedly interconnecting the rearward ends of said pair of leaf springs, and such that said leaf springs provide said biasing force to resist outward separation of said forward ends.

5. The apparatus as defined in claim 4 wherein said fastener retainer assembly is slidably mounted to said barrel to permit limited axial reciprocation thereof and such that the fastener retainer assembly is moved forwardly a predetermined distance when said positioning member is moved axially forwardly by said trigger means and the head portion of a fastener engages said forward end portions of said fastener retainer assembly.

6. The apparatus as defined in claim 5 further comprising biasing means for biasing said fastener retainer assembly in the rearward direction.

7. An apparatus for driving fasteners serially delivered thereto into a workpiece, with the fasteners each having a portion and a pointed shank portion extending from said head portion, and comprising a tubular barrel having an internal bore which defines a forward outlet end, and having a fastener inlet opening located rearwardly from said outlet end, a pair of leaf springs mounted to said barrel, with said leaf springs each including a forward end and a rearward end, with said forward ends extending laterally into said bore from opposite sides of said barrel and between said fasteners inlet opening and said outlet end of said barrel, and with said forward ends each being resiliently biased such that the same may be laterally moved outwardly against a biasing force to open said bore, a tubular fastener positioning member slidably mounted in said bore of said barrel rearwardly of said fastener inlet opening, a fastener driver mounted in said bore to slidably extend coaxially through said tubular fastener, and trigger means for, upon manual actuation, (a) moving the positioning member axially forwardly to cause the head portion of a fastener in said bore to engage said forward ends of said leaf springs and thereby coaxially align the fastener in said bore, and then (b) rapidly axially advancing said fastener driver so as to engage the head portion of the aligned fastener and drive the fastener forwardly, and thereby cause the forward ends of said leaf springs to be laterally moved outwardly against said biasing force to permit the passage of the fastener forwardly through said outlet end of said bore, and for, upon manual release (c) returning the positioning member and the fastener driver axially rearwardly.

8. The apparatus as defined in claim 7 further comprising a support member fixedly interconnecting the rearward ends of said pair of leaf springs to define a fastener retainer assembly, and wherein said fastener retainer assembly is slidably mounted to said barrel to permit limited axial reciprocation thereof and such that the fastener retainer assembly is moved forwardly a predetermined distance when said positioning member is moved axially forwardly by said trigger means and the head portion of a fastener engages said forward ends of said leaf springs.

9. The apparatus as defined in claim 8 further comprising biasing means for biasing said fastener retainer assembly in the rearward direction.

10. A method of operating a fastener driving apparatus which comprises a tubular barrel having an internal bore which defines a forward outlet end, and having a fastener inlet opening located rearwardly from said outlet end, a pair of leaf springs mounted to said barrel, with said leaf springs each including a forward end which extends laterally into said bore from opposite sides of said barrel and between said fastener inlet opening and said outlet end of said barrel, and with said forward ends each being resiliently biased such that the same may be laterally moved outwardly against a biasing force to open said bore, a tubular fastener positioning member slidably mounted in said bore of said barrel rearwardly of said fastener inlet opening, and a fastener driver mounted in said bore to slidably extend coaxially through said tubular fastener, said method comprising the sequential steps of (a) serially delivering a fastener which comprises a head portion and a shank portion which has a pointed forward end, through said fastener inlet opening and into said bore of said tubular barrel with the shank portion positioned forwardly of said head portion, (b) moving the positioning member axially forwardly to cause the head portion of the fastener in said bore to engage said forward ends of said leaf springs and thereby coaxially align the fastener in said bore, (c) rapidly axially advancing said fastener driver so as to engage the head portion of the aligned fastener and drive the fastener forwardly, and thereby cause the forward against said biasing force to cause the fastener to pass forwardly through said outlet end of said bore, (d) returning the positioning member and the fastener driver axially rearwardly, and (e) cyclically repeating steps (s) through (d).

11. The method as defined in claim 10 wherein step (b) causes said forward ends of said leaf springs to be moved partially outwardly from said bore, and step (c) causes said ends to be moved outwardly further from said bore.

12. The method as defined in claim 11 wherein said pair of leaf springs have rearward end which are fixedly interconnected to a support member, and said support member is slidably mounted to said barrel to permit limited axial reciprocation thereof, and wherein step (b) causes said support member and pair of leaf springs to be moved axially forwardly a predetermined distance and such that said pointed forward end of said shank portion of said fastener is substantially aligned with said forward outlet end of said bore of said tubular member, and said support member and pair of leaf springs are moved axially rearwardly during step (d).

* * * * *

UNITED STATES PATENT AND TRADEMARK OFFICE

CERTIFICATE OF CORRECTION

PATENT NO. :5,098,003

DATED :March 24, 1992

INVENTOR(S) :Alfred Young et al.

It is certified that error appears in the above-identified patent and that said Letters Patent is hereby corrected as shown below:

Column 4, line 52 "6-7" should be -- 5-7 --.

Column 5, line 42, "set" should be -- seat --.

Column 5, line 42, "to" should be -- of -- (second occurrence).

Column 6, line 49, after "barrel" insert a comma -- , --.

Column 8, line 54, after "forward" insert -- ends of said leaf springs to be laterally moved outwardly --.

Column 8, line 59, "(s)" should be -- (a) --.

Column 8, line 66, "end" should be -- ends --.

Signed and Sealed this

Twenty-eighth Day of September, 1993

Bruce Lehman

*Attest:*

BRUCE LEHMAN

*Attesting Officer*

*Commissioner of Patents and Trademarks*